US010631097B2

(12) United States Patent
Liu

(10) Patent No.: US 10,631,097 B2
(45) Date of Patent: Apr. 21, 2020

(54) SPEAKER

(71) Applicant: AAC Technologies Pte. Ltd., Singapore (SG)

(72) Inventor: Xiaodong Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/529,727

(22) Filed: Aug. 1, 2019

(65) Prior Publication Data

US 2020/0053478 A1 Feb. 13, 2020

(30) Foreign Application Priority Data

Aug. 13, 2018 (CN) ..... 2018 2 1305364 U

(51) Int. Cl.

| | |
|---|---|
| ***H04R 9/06*** | (2006.01) |
| ***H04R 7/20*** | (2006.01) |
| ***H04R 7/18*** | (2006.01) |
| ***H04R 9/04*** | (2006.01) |

(52) U.S. Cl.

CPC ..... *H04R 9/06* (2013.01); *H04R 7/18* (2013.01); *H04R 7/20* (2013.01); *H04R 9/045* (2013.01); *H04R 9/046* (2013.01); *H04R 2307/207* (2013.01); *H04R 2400/11* (2013.01); *H04R 2499/11* (2013.01)

(58) Field of Classification Search

CPC ..... H04R 9/043; H04R 9/45; H04R 9/046; H04R 9/06; H04R 7/20; H04R 2307/207; H04R 2400/11; H04R 2499/11; H04R 9/045; H04R 7/18

USPC ..... 381/398, 403, 404, 405, 431

See application file for complete search history.

(56) References Cited

U.S. PATENT DOCUMENTS

| | | | | |
|---|---|---|---|---|
| 10,250,993 | B1 * | 4/2019 | Xiao | H04R 9/06 |
| 10,277,986 | B2 * | 4/2019 | Li | H04R 9/043 |
| 2013/0156237 | A1 * | 6/2013 | Kim | H04R 9/06 381/191 |
| 2018/0302724 | A1 * | 10/2018 | Li | H04R 9/043 |

* cited by examiner

*Primary Examiner* — Huyen D Le

(74) *Attorney, Agent, or Firm* — W&G Law Group LLP

(57) ABSTRACT

A speaker includes a holder, and a vibration unit and a magnetic circuit unit that are fixedly connected to the holder. The vibration unit includes a first diaphragm, a voice coil, and an elastic support. The elastic support includes a flexible circuit board and a second diaphragm. The second diaphragm includes a first and a second fixing portion, and a suspension connecting the first to the second fixing portion. The flexible circuit board includes a first and a second connection portion, and an elastic arm connecting the first to the second connection portion. The elastic arm includes a first elastic arm extending from the first connection portion and a second elastic arm extending by reversely bending from the first elastic arm and connected to the second connection portion, and an orthographic projection of a reverse bending joint between the first and the second elastic arm is outside the suspension.

4 Claims, 5 Drawing Sheets

SPEAKER

TECHNICAL FIELD

The present disclosure relates to the field of electroacoustic transformation, and in particular, to a speaker.

BACKGROUND

With the rapid development of mobile communication technologies in recent years, consumers are increasingly using mobile communication devices with voice functions, such as portable phones, handheld game consoles and laptops. As a voice playback device, the design of a speaker directly affects voice performance of mobile communication device products. High requirements on the design of a flexible circuit board of the speaker are put forward so as to meet the market requirements for thinning and high tone quality.

In the related art, the speaker includes a holder, a vibration unit and a magnetic circuit unit. The vibration unit and the magnetic circuit unit are fixedly connected to the holder. The vibration unit includes a first diaphragm, a voice coil positioned under the first diaphragm and driving the first diaphragm to vibrate to produce sound, and an elastic support positioned under the voice coil and elastically supporting the voice coil. The elastic support includes a flexible circuit board and a second diaphragm stacked on the flexible circuit board. The length of the elastic arm of the flexible circuit board is increased by bending two sections of elastic arms reversely. However, a reverse bending joint between the two sections of elastic arms is disposed in a range covered by the second diaphragm. When the elastic arm vibrates, its maximum deformation occurs at the reverse bending joint between the two sections of elastic arms, and it is easy to collide with the second diaphragm during vibration, causing a sound difference and affecting acoustic performance of the speaker.

Therefore, it is necessary to provide a novel speaker so as to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding portions throughout the several views.

DESCRIPTION OF EMBODIMENTS

The present invention will be further illustrated with reference to the accompanying drawings and the embodiments.

Figure 1:
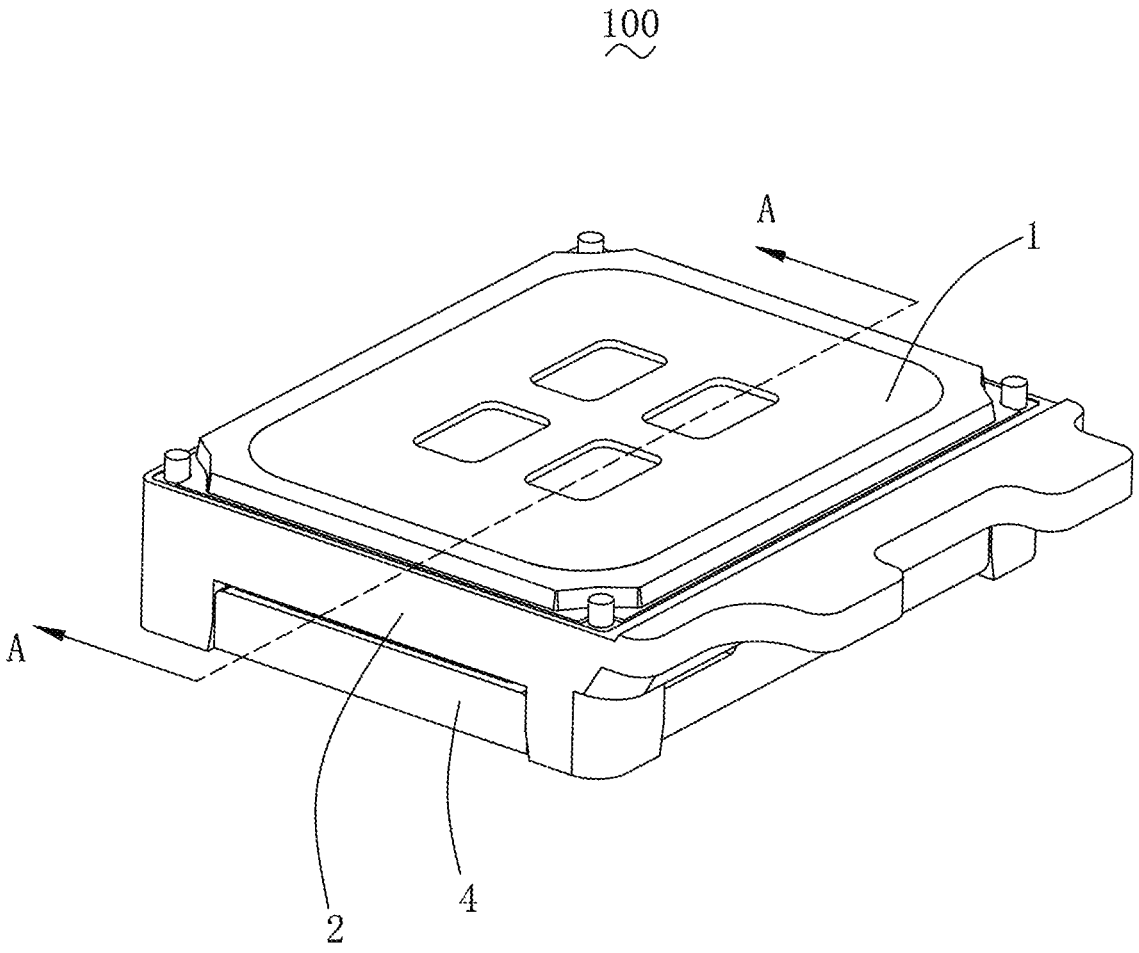
FIG. 1 is a perspective structural schematic diagram of a speaker according to the present disclosure.
Figure 2:
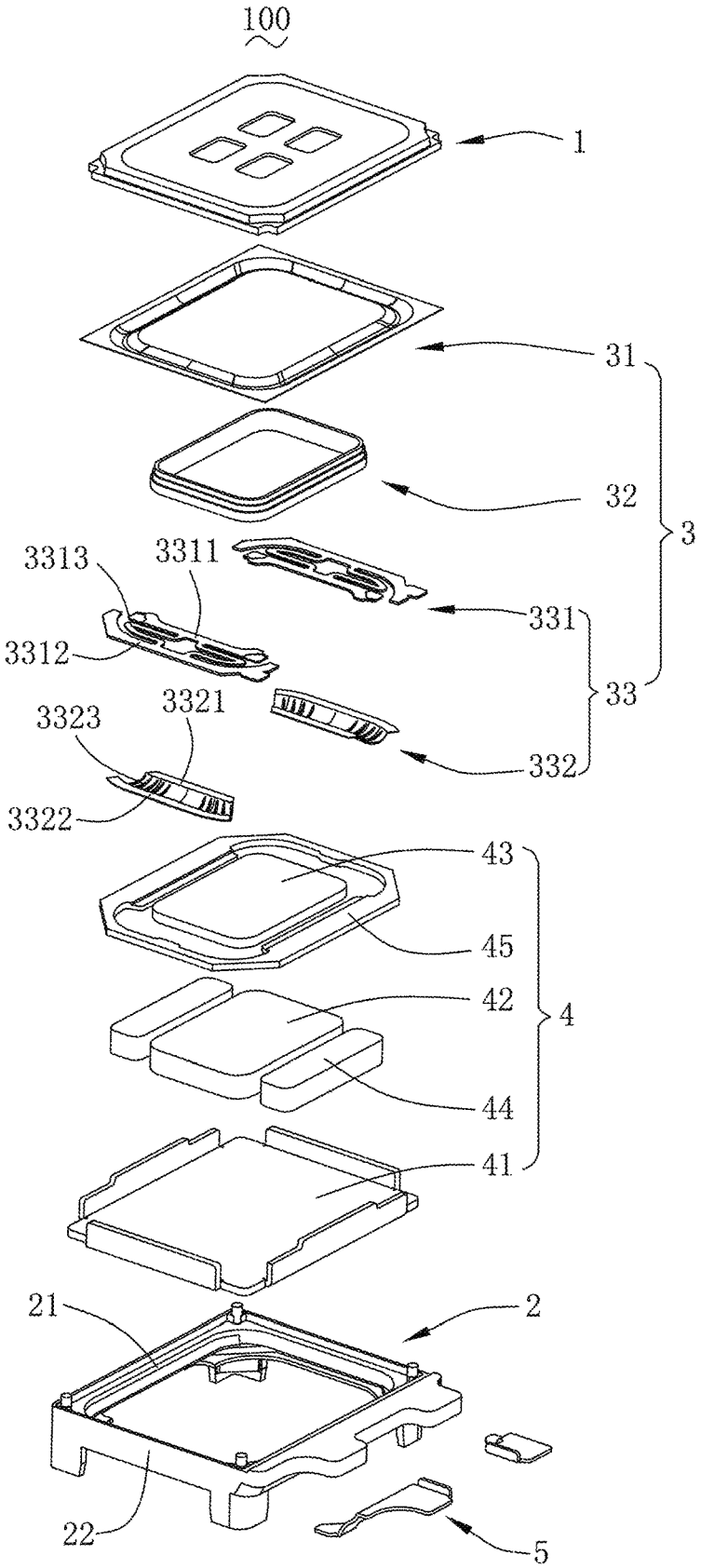
FIG. 2 is an exploded structural schematic diagram of the speaker as shown in FIG. 1.
Figure 3:
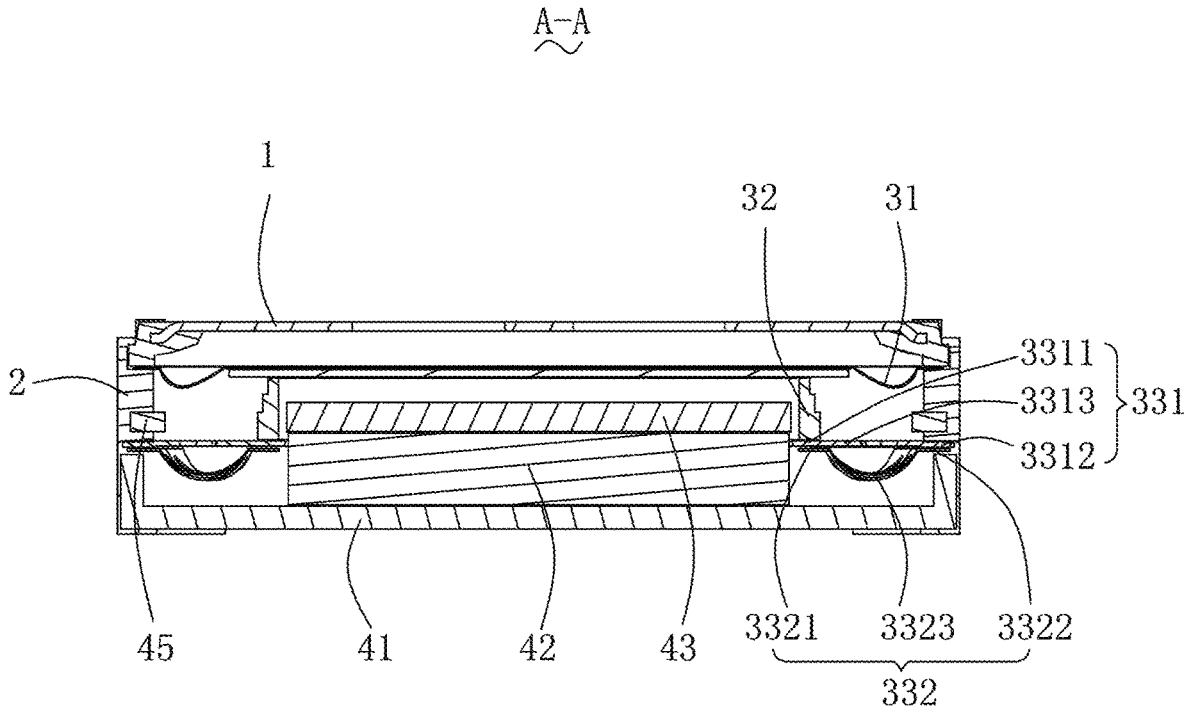
FIG. 3 is a cross-sectional diagram of the speaker as shown in FIG. 1 taken along line A-A.
Figure 4:
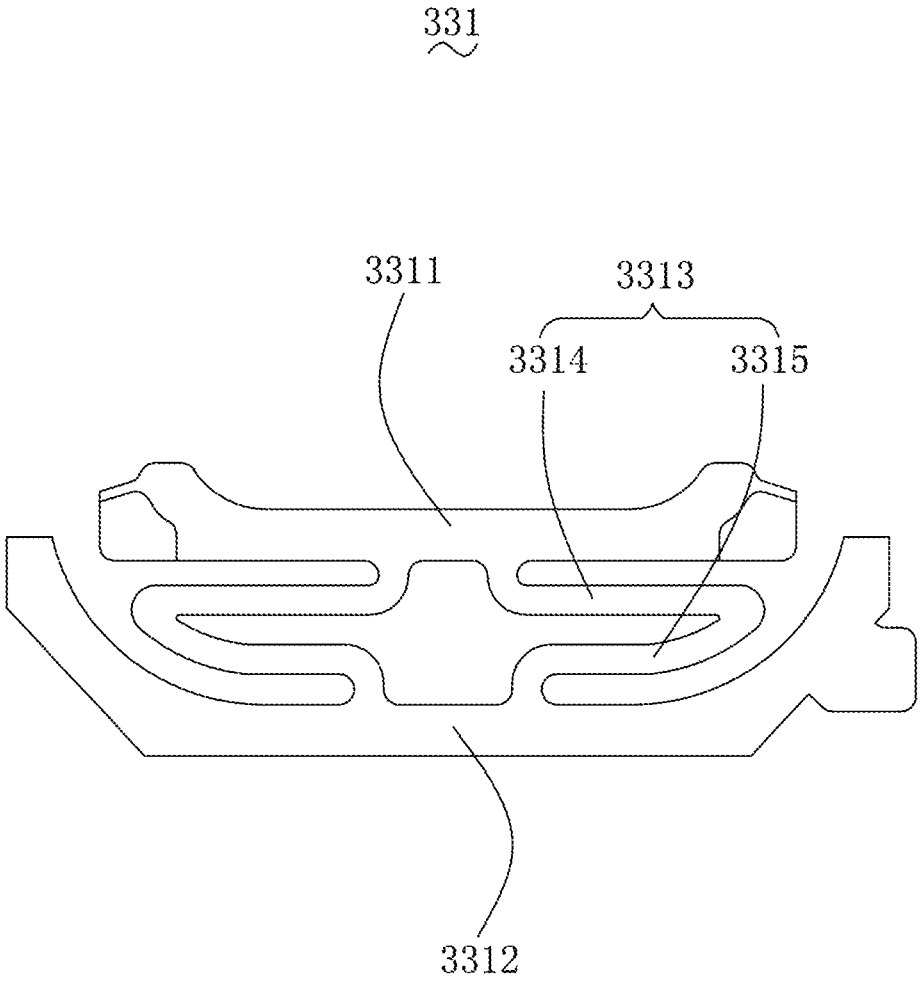
FIG. 4 is a front view of the flexible circuit board as shown in FIG. 2.
Figure 5:
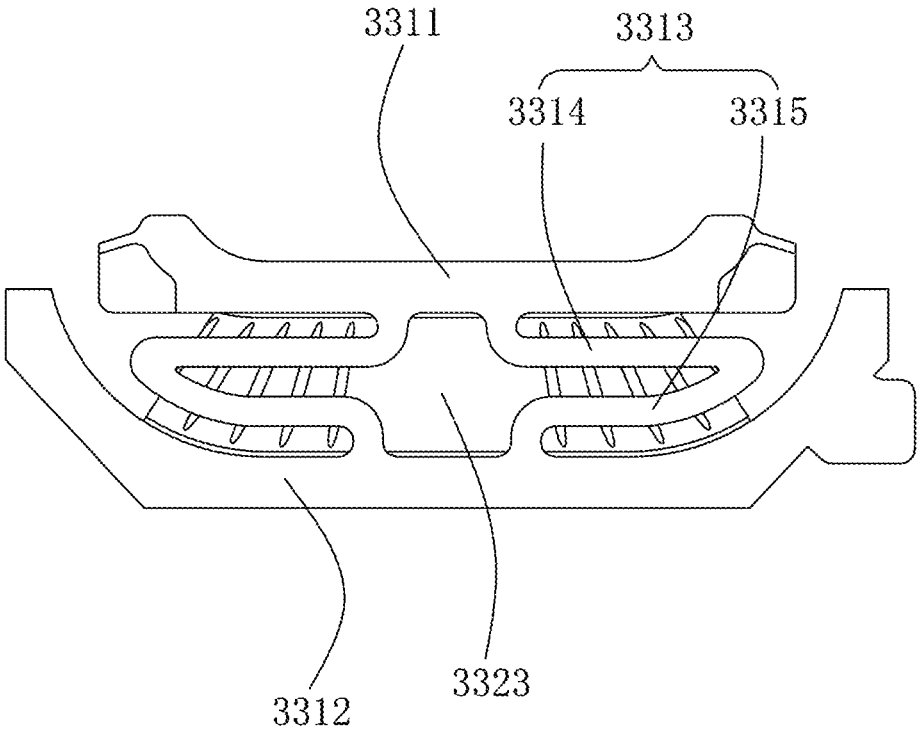
FIG. 5 is a front view of a cooperating structure of the second diaphragm and the flexible circuit board in the speaker according to the present disclosure.

Referring to FIG. 1 to FIG. 5, a speaker 100 is provided. The speaker 100 includes an upper cover 1, a holder 2 cooperating with the upper cover 1 to form a receiving space, a vibration unit 3 fixedly connected to the holder 2, a magnetic circuit unit 4 for driving the vibration unit 3 to vibrate to produce sound, and a conductive terminal 5 connected to an external circuit.

The holder 2 is of a rectangular frame structure, including two long sides 21 that are spaced apart from and in parallel to each other, and two short sides 22 disposed on two ends of the long sides 21 and connected to the two long sides 21. The long sides 21 and the short sides 22 are connected end to end in sequence. The upper cover 1 covers the holder 1, and cooperates with the holder 1 to form a receiving space. The vibration unit 2 and the magnetic circuit unit 3 are received in the receiving space.

The vibration unit 3 is used to vibrate to produce sound. Specifically, the vibration unit 3 includes a first diaphragm 31 for vibrating to produce sound, a voice coil 32 positioned under the first diaphragm 31 and driving the first diaphragm 31 to vibrate to produce sound, and an elastic support 33 positioned under the voice coil 32 and elastically supporting the voice coil 32. Two elastic supports 33 are provided, and the two elastic supports 33 are symmetrically disposed on two opposite sides of the holder 2. Specifically, the elastic supports 33 are fixedly connected to the short sides 22 of the holder 2.

The elastic supports 33 each include a flexible circuit board 331 and a second diaphragm 332 stacked on the flexible circuit board 331. The flexible circuit board 331 is used to support the voice coil 32, and to be electrically connected to an external power source. The second diaphragm 332 is used to strengthen the vibration of the first diaphragm 31 and can prevent the polarization of the first diaphragm 31.

One end of the flexible circuit board 331 is fixedly connected to the voice coil 32, and the other end is fixedly connected to the holder 2. The flexible circuit board 331 includes a first connection portion 3311 fixedly connected to the voice coil 32, a second connection portion 3312 spaced apart from the first connection portion 3311 and fixedly connected to the holder 2, and an elastic arm 3313 connecting the first connection portion 3311 to the second connection portion 3312.

Further, two elastic arms 3313 are provided for each of the flexible circuit boards 331, and the two elastic arms 3313 are symmetrically disposed about a central axis of the flexible circuit board 331. The two elastic arms 3313 cooperate with the first connection portion 3311 and the second connection portion 3312 to form a closed loop structure and share the load of the flexible circuit board 331, which can effectively increase the load capacity of the flexible circuit board 331.

The elastic arm 3313 includes a first elastic arm 3314 extending from the first connection portion 3311 and a second elastic arm 3315 extending from the first elastic arm 3314 by reversely bending and connected to the second connection portion 3312. The first elastic arm 3314 and the second elastic arm 3315 are integrally formed by smooth transition.

The second diaphragm 332 includes a first fixing portion 3321 fixedly connected to the voice coil 32, a second fixing portion 3322 spaced apart from the first fixing portion 3321, and a suspension 3323 connecting the first fixing portion 3321 to the second fixing portion 3322.

It should be appreciated that the second diaphragm 332 can be disposed under the flexible circuit board 331, and in this case, the suspension 3323 is a convex structure downwardly protruding along a direction facing away from the first diaphragm 31. The second diaphragm 332 can also be disposed above the flexible circuit board 331, and in this case, the suspension 3323 is a convex structure upwardly protruding along a direction close to the first diaphragm 31. In this embodiment, the second diaphragm 332 is disposed under the flexible circuit board 331.

When the elastic arm 3313 vibrates, its maximum deformation occurs at the reverse bending joint between the first elastic arm 3314 and the second elastic arm 3315. An orthographic projection of a reverse bending joint between the first elastic arm 3314 and the second elastic arm 3315 along a direction of the suspension 3323 is outside the suspension 3323, so that when the elastic arm 3313 vibrates, the suspension 3323 of the second diaphragm 332 can be bypassed, avoiding a collision between the flexible circuit board 331 and the second diaphragm 332, increasing the vibration space of the elastic arm 3313, and thereby improving the acoustic performance of the speaker 100.

The magnetic circuit unit 4 is used to drive the vibration unit 3 to vibrate to produce sound. Specifically, the magnetic circuit unit 4 includes a yoke 41 fixedly connected to the holder 2, a main magnet 42 assembled at the center of the yoke 41, a main pole plate 43 attached to the surface of the main magnet 42, an auxiliary magnet 44 disposed around the main magnet 42, and an auxiliary pole plate 45 attached to the auxiliary magnet 44.

The main magnet 42 is spaced apart from the auxiliary magnet 44 to form a magnetic gap. The voice coil 32 is suspended in the magnetic gap. The main pole plate 43 and the auxiliary pole plate 45 are made of a permeability magnetic material to achieve magnetic permeability.

The conductive terminal 5 is connected to the flexible circuit board 331 and to the external power source, thus switching on the circuit of the speaker 100. Two conductive terminals 5 are provided, and the two conductive terminals 5 are located on the same side of the holder 2.

Compared with the related art, in the speaker 100 provided in the present disclosure, an orthographic projection of a reverse bending joint between the first elastic arm 3314 and the second elastic arm 3315 along a direction of the suspension 3323 is outside the suspension 3323, so that when the elastic arm 3313 vibrates, the suspension 3323 of the second diaphragm 332 can be bypassed, avoiding a collision between the flexible circuit board 331 and the second diaphragm 332, increasing the vibration space of the elastic arm 3313, and thus improving the acoustic performance of the speaker 100.

The above merely are the embodiments of the present disclosure, and it should be noted that those skilled in the art can also make improvements, without departing from the creative conception of the present disclosure, which all shall fall within the scope of the present disclosure.

What is claimed is:

1. A speaker, comprising:

a holder;

a vibration unit comprising a first diaphragm, a voice coil positioned under the first diaphragm and configured to drive the first diaphragm to vibrate to produce sound, and at least one elastic support positioned under the voice coil and elastically supporting the voice coil; and a magnetic circuit unit;

wherein the vibration unit and the magnetic circuit unit are fixedly connected to the holder;

each of the at least one elastic support comprises a flexible circuit board and a second diaphragm stacked on the flexible circuit board; the second diaphragm comprises a first fixing portion fixedly connected to the voice coil, a second fixing portion spaced apart from the first fixing portion and fixedly connected to the holder, and a suspension connecting the first fixing portion to the second fixing portion; the flexible circuit board comprises a first connection portion fixedly connected to the voice coil, a second connection portion spaced apart from the first connection portion and fixedly connected to the holder, and at least one elastic arm connecting the first connection portion to the second connection portion, the at least one elastic arm each comprises a first elastic arm extending from the first connection portion and a second elastic arm formed by extending from the first elastic arm while being bent reversely, the second elastic arm being connected to the second connection portion, and an orthographic projection of a joint between the first elastic arm and the second elastic arm towards the suspension is outside the suspension;

the second diaphragm is disposed below the flexible circuit board, and the suspension is a convex structure downwardly protruding along a direction facing away from the first diaphragm.

2. The speaker as described in claim 1, wherein the second diaphragm is disposed above the flexible circuit board, and the suspension is a convex structure upwardly protruding along a direction facing toward the first diaphragm.

3. The speaker as described in claim 1, wherein the at least one elastic support comprises two elastic supports, and the two elastic supports are symmetrically disposed on two opposite sides of the holder.

4. The speaker as described in claim 3, wherein the at least one elastic arm comprises two elastic arms, and the two elastic arms are symmetrically disposed about a central axis of the flexible circuit board.

* * * * *